US006776471B2

(12) United States Patent
Nojima

(10) Patent No.: US 6,776,471 B2
(45) Date of Patent: Aug. 17, 2004

(54) RECORDING APPARATUS

(75) Inventor: Takashi Nojima, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/211,642

(22) Filed: Aug. 5, 2002

(65) Prior Publication Data

US 2003/0030683 A1 Feb. 13, 2003

(30) Foreign Application Priority Data

Aug. 6, 2001 (JP) ..... 2001-237675

(51) Int. Cl.[7] ..... B41J 29/393; B41J 2/195
(52) U.S. Cl. ..... 347/19; 347/7
(58) Field of Search ..... 347/7, 14, 19, 347/85

(56) References Cited

U.S. PATENT DOCUMENTS

| | | | | |
|---|---|---|---|---|
| 5,153,613 A | | 10/1992 | Yamaguchi et al. | 347/30 |
| 5,315,317 A | | 5/1994 | Terasawa et al. | 346/1.1 |
| 5,619,237 A | | 4/1997 | Inoue et al. | 347/86 |
| 5,717,445 A | | 2/1998 | Kida et al. | 347/33 |
| 5,742,308 A | * | 4/1998 | Cowger et al. | 347/85 |
| 5,751,301 A | | 5/1998 | Saikawa et al. | 347/8 |
| 5,933,174 A | | 8/1999 | Kawazoe et al. | 347/85 |
| 5,980,030 A | | 11/1999 | Fujii | 347/85 |
| 6,062,667 A | | 5/2000 | Matsui et al. | 347/19 |
| 6,120,128 A | | 9/2000 | Kawakami et al. | 347/37 |
| 6,209,980 B1 | * | 4/2001 | Kobayashi et al. | 347/7 |
| 6,471,314 B2 | * | 10/2002 | Doi | 347/5 |
| 2002/0063745 A1 | * | 5/2002 | Osborne | 347/19 |
| 2003/0007045 A1 | | 1/2003 | Yoshida et al. | 347/86 |
| 2003/0007047 A1 | | 1/2003 | Otsuka et al. | 347/89 |
| 2003/0007048 A1 | | 1/2003 | Otsuka et al. | 347/89 |
| 2003/0063167 A1 | | 4/2003 | Yoshida et al. | 347/85 |

FOREIGN PATENT DOCUMENTS

| | | | |
|---|---|---|---|
| JP | 7-32606 | 2/1995 | B41J/2/175 |

* cited by examiner

*Primary Examiner*—Stephen D. Meier
*Assistant Examiner*—Alfred Dudding
(74) *Attorney, Agent, or Firm*—Fitzpatrick, Cella, Harper & Scinto

(57) ABSTRACT

A recording apparatus, including a reciprocating carriage equipped with a record head, an on-carriage first ink tank, a second ink tank distant from the carriage, an ink supply unit for supplying the ink from the second ink tank to the first ink tank, and a remaining ink amount detection unit for detecting a remaining ink amount in the first ink tank, calculates and stores an ink amount required to record a part of the image data while the image data reception, calculates and stores a maximum ink amount required to record the image data except for the above calculated portion, and then starts the record operation at a time when a sum total value of the stored ink amount required and the stored maximum ink amount becomes lower than the remaining ink amount, whereby the ink can be supplied and refilled effectively and appropriately.

16 Claims, 5 Drawing Sheets

RECORDING APPARATUS

BACKGROUND OF THE INVENTION

1. Field of the Invention

The present invention relates to a recording apparatus and a recording method which perform recording by applying ink to a record medium, and more particularly, to the structure of an ink supply system and an ink supply method.

2. Related Background Art

In a recording apparatus of serial scan type, represented by an ink-jet recording apparatus, which performs recording by applying ink to a record medium, a so-called on-carriage tank system, a tube system, an on-demand system, an intermittent supply system or the like is adopted as a system of supplying the ink to a record head. The on-carriage tank system is the system that an ink tank is mounted on a carriage on which the record head is mounted, and the ink is supplied from the ink tank to the record head. The tube system is the system that an ink tank is disposed at the position distant from a carriage, the ink tank and the record head are connected to each other by a flexible tube or the like, and the ink is thus supplied through this tube. In the on-demand system, ink tanks are disposed both on a carriage and at the position distant from this carriage, and the ink is ordinarily supplied from the ink tank on the carriage to the record head. In this structure, only when an ink amount of the ink tank on the carriage lowers, both the ink tanks are connected to each other to supply the ink from the ink tank outside the carriage to the ink tank on the carriage.

In the on-carriage tank system, there is a case where a record-head-integrated ink tank integrally containing the record head and the ink tank is used. On the other hand, there is also a case where a head/tank separation/exchange ink tank in which only the ink tank is exchangeable is used to prevent that the record head is disposed according to exchange of the ink tank and to reduce running costs. In the on-carriage tank system as above, it is demanded to lower exchange frequency of the ink tank so as to reduce the running costs and decrease a load of user's operation, whereby it is necessary to enlarge the capacity of the ink tank. However, if the capacity of the ink tank mounted on the carriage is enlarged, the weight of the entire carriage increases proportionally, whereby it becomes necessary to enlarge the apparatus as a whole and also reinforce the carriage driving unit and the carriage supporting unit.

Moreover, in the tube system, the tube brings a load to the movement of the carriage. Particularly, in recent years, the tube of which the ink supply amount per unit time is larger is required, and the weight of the tube in the ink supply state tends to increase, whereby the load to the carriage by the tube increases more and more. Moreover, since inertia force due to the movement of the carriage is applied to the ink inside the tube, an ink supply pressure varies, and there is a fear that unevenness in recording occurs.

In order to cope with such problems in the on-carriage tank system and the tube system, the intermittent supply system in which an ink tank (on-carriage ink tank) on a carriage and a main ink tank at the position distant from the carriage are connected to each other as needed to appropriately supply the ink to the on-carriage ink tank is proposed. In the intermittent supply system, the capacity of the on-carriage ink tank to which the ink is appropriately supplied can be small, and, ordinarily a user can supply the ink by exchanging the main ink tank. Here, since the main ink tank is disposed outside the carriage, the load to the carriage does not increase even if the capacity of this tank is enlarged, Thus, by enlarging the capacity of the main ink tank, it is possible to lower the exchange frequency of the ink tank and thus decrease the load of the user's operation and the running costs.

As to the method of supplying the ink from the main ink tank to the on-carriage ink tank according to the intermittent supply system, the sequence to cause the apparatus to perform the ink supply is disclosed in U.S. Pat. No. 5,980,030. In this sequence, if the Ink of the on-carriage ink tank becomes equal to or lower than a predetermined level, the main ink tank and the on-carriage ink tank are connected to each other to supply the ink from the main ink tank to the on-carriage ink tank.

In the case where the sequence disclosed in U.S. Pat. No. 5,980,030, when the ink of the on-carriage ink tank becomes equal to or lower than the predetermined level, for example, the supply operation is performed even while the recording of one page is being performed. Since a certain time is required to perform the supply operation, if the supply operation is performed even while the recording of one page is being performed, there frequently occurs an extreme difference between the penetration times of the ink applied to the record medium before and after the supply operation. For this reason, there is a fear that band-like recorded unevenness occurs on a recorded image.

As a method of solving such a problem, the method disclosed in Japanese Patent Application Laid-Open No. 7-32606 is known. In this method, record data of a next page is stored beforehand in a memory of a recording apparatus, and then an ink amount required to record the next page is calculated on the basis of the stored record data. Then, if the ink amount held in the on-carriage ink tank is less than the calculated ink amount required to record the next page, the ink is supplied prior to the recording of the next page. However, in the method disclosed in Japanese Patent Application Laid-Open No. 7-32606, it is judged after the image data of one page is completely received whether or not the ink supply operation should be performed, and the record operation starts thereafter, whereby there is a drawback that a time from the beginning of the transmission of the image data to the end of the recording is prolonged. Moreover, in this method, since it is required to once store the entire record data of one page, a memory having a large capacity is required.

Moreover, there is also proposed another method in which, on the basis of the ink amount (called a maximum-required ink amount) which is required to record, on a page to be recorded next time, a so-called solid image corresponding to the image to which the ink should be maximally applied, it is judged whether the ink amount held in the on-carriage ink tank is less than the maximum-required ink amount. If the judgement is affirmative, the ink supply operation is performed. However, in this method, there is a case where the ink supply operation is performed even if the ink sufficient to actually perform the recording remains, whereby waste of time increases in the record operation.

SUMMARY OF THE INVENTION

An object of the present invention is to provide, in a recording apparatus of intermittent supply system, a recording apparatus and a recording method which can supply ink from a main ink tank to an on-carriage ink tank at appropriate timing, without performing an ink supply operation during a record operation of one page and delaying a start of the record operation.

Another object of the present invention is to provide an ink-jet recording apparatus which performs recording by emitting ink from a record head to a record medium in accordance with record data, comprising a carriage, equipped with the record head, for performing reciprocation, a first ink tank mounted on the carriage, a second ink tank disposed at a position distant from the carriage, an ink supply means for supplying the ink from the second ink tank to the first ink tank, a remaining ink amount detection means for detecting a remaining ink amount in the first ink tank, a first calculation storage means for calculating and storing an ink amount required to record a part of the image data while the image data is being received, a second calculation storage means for calculating and storing a maximum ink amount required to store the image data except for the portion calculated by the first calculation storage means, and a control means for starting the record operation at a time when a sum total value of the ink amount stored in the first calculation storage means and the maximum ink amount stored in the second calculation storage means becomes lower than the ink amount detected by the remaining ink amount detection means.

BRIEF DESCRIPTION OF THE DRAWINGS

FIG. 2A shows a state that the carriage is at a supply position, and FIG. 2B shows a state that a supply tube is moved to the supply position;

DESCRIPTION OF THE PREFERRED EMBODIMENTS

Hereinafter, the embodiments of the present invention will be explained with reference to the attached drawings.

(First Embodiment)

Figure 1:
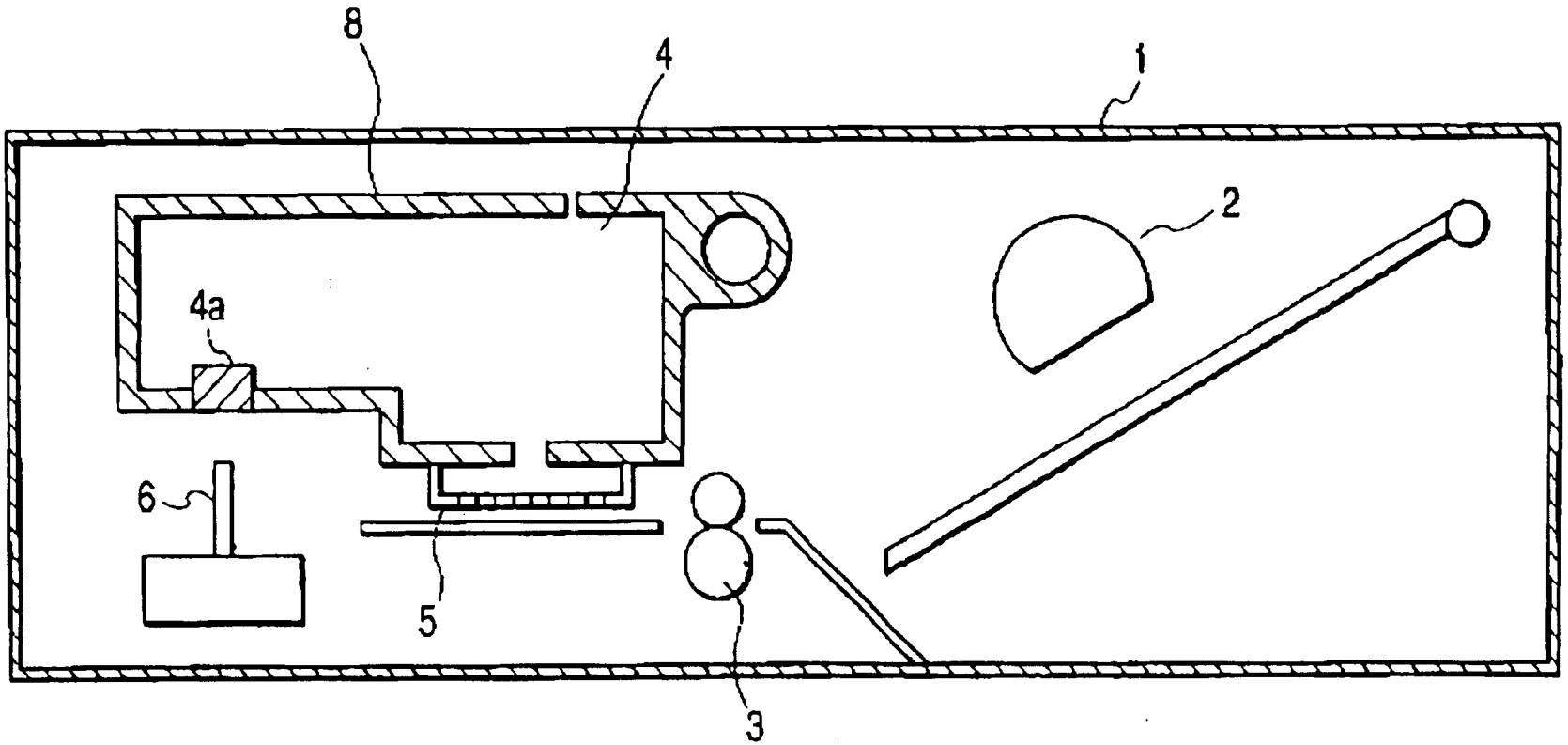
FIG. 1 is a typical sectional diagram showing a recording apparatus according to the first embodiment of the present invention.

FIG. 1 is a typical sectional diagram showing a recording apparatus 1 according to the first embodiment of the present invention. The recording apparatus 1 includes a paper feed unit 2 which separates and feeds plural stacked record media one by one. Further, a conveyance roller (conveyance means) 3 which conveys the record medium fed by the paper feed unit 2 is provided posterior to the paper feed unit 2, and a movement path of a carriage 8 on which a record head 5 for applying ink to the record medium extends in the direction (main scan direction) intersecting a conveyance direction (sub-scan direction) on a conveyance path of the record medium conveyed by the conveyance roller 3. An on-carriage ink tank 4 which holds the ink to be supplied to the record head 5 is mounted on the carriage 8, and the carriage 8 can be reciprocated by a not-shown driving mechanism in the main scan direction along a not-shown guide rail or the like.

The recording apparatus 1 performs a recording operation as follows. First, the plural record media stacked on the paper feed unit 2 are separated and supplied one by one to the conveyance roller 3, and the record medium is then conveyed by the conveyance roller 3 until the record start portion of the record medium reaches the record section located below the movement path of the carriage 8. Next, the carriage 8 is moved to drive the record head 5 at predetermined timing, whereby the recording of a predetermined width is performed. After then, the record medium is again conveyed by the conveyance roller 3 by a predetermined amount according to the recording width, and the carriage 8 is again moved to again perform the recording of the predetermined width. As above, the recording of the predetermined width and the conveyance of the predetermined amount are repeated, whereby an image is recorded at a desired area on the record medium.

In addition to the on-carriage ink tanks 4, a main ink tank 19 (FIG. 2A) which holds the ink to be supplied to each on-carriage ink tank 4 is provided in the recording apparatus 1 of the present embodiment. The ink is supplied from the main ink tank 19 to each on-carriage ink tank 4 on the basis of the intermittent supply system for performing the ink supply by connecting the main ink tank 19 to the on-carriage ink tanks 4 only as needed.

As the structure of connecting the main ink tank 19 to the on-carriage ink tanks 4, supply tubes 6 which are connected to the main ink tank 19 are provided in the recording apparatus 1. Further, an ink inlet is provided through each on-carriage ink tank 4, and a valve 4*a* is provided inside the inlet. The valve 4*a* which consists of an elastic body such as butyl rubber having the thickness of about 2 mm to 5 mm is structured so that the supply tube 6 can be put in and pulled out without leaking the ink. The supply tube 6 is manufactured by an SUS (Special Use Stainless steel) or the like of which the shape has been formed like a hollow tube.

Figure 2A:
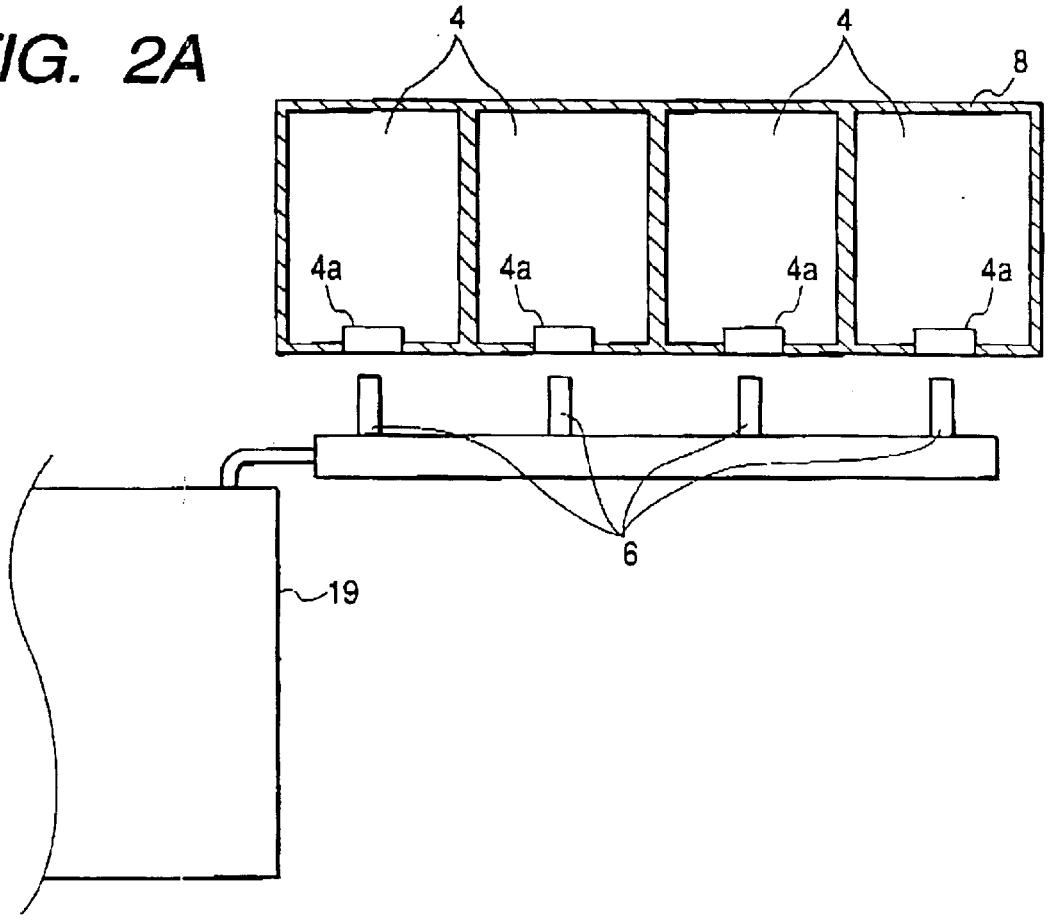
FIGS. 2A and 2B are typical diagrams showing partial sections of the structure on the periphery of an on-carriage ink tank of the recording apparatus shown in FIG. 1.
Figure 2B:
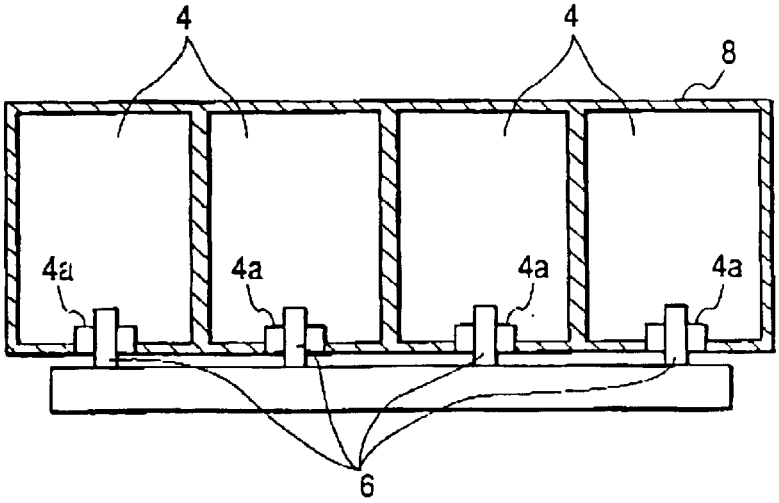

The recording apparatus 1 of the present embodiment is the apparatus which can perform color image recording by applying inks of plural colors to the record medium, and the plural on-carriage ink tanks 4 respectively corresponding to the plural colors are provided as shown in FIGS. 2A and 2B. The valve 4*a* is provided in each on-carriage ink tank 4, and the supply tube 6 is independently provided for each color.

Next, the ink supply operation from the main ink tank 19 to the on-carriage ink tanks 4 will be explained with reference to FIGS. 2A and 2B. FIGS. 2A and 2B are the typical diagrams showing the partial sections of the structure on the periphery of the on-carriage ink tank 4 in the state that the carriage 8 is at the supply position to perform the ink supply operation.

The supply tube 6 is supported at the position where the end of each tube faces the corresponding valve 4*a* in the state that the carriage 8 is at the ink supply position. The end of the supply tube 6 can be moved to a pull-off position distant from the valve 4*a* as shown in FIG. 2A and to a supply position where the end is inserted into the valve 4*a* as shown in FIG. 2B, by a not-shown movement means.

Figure 3:
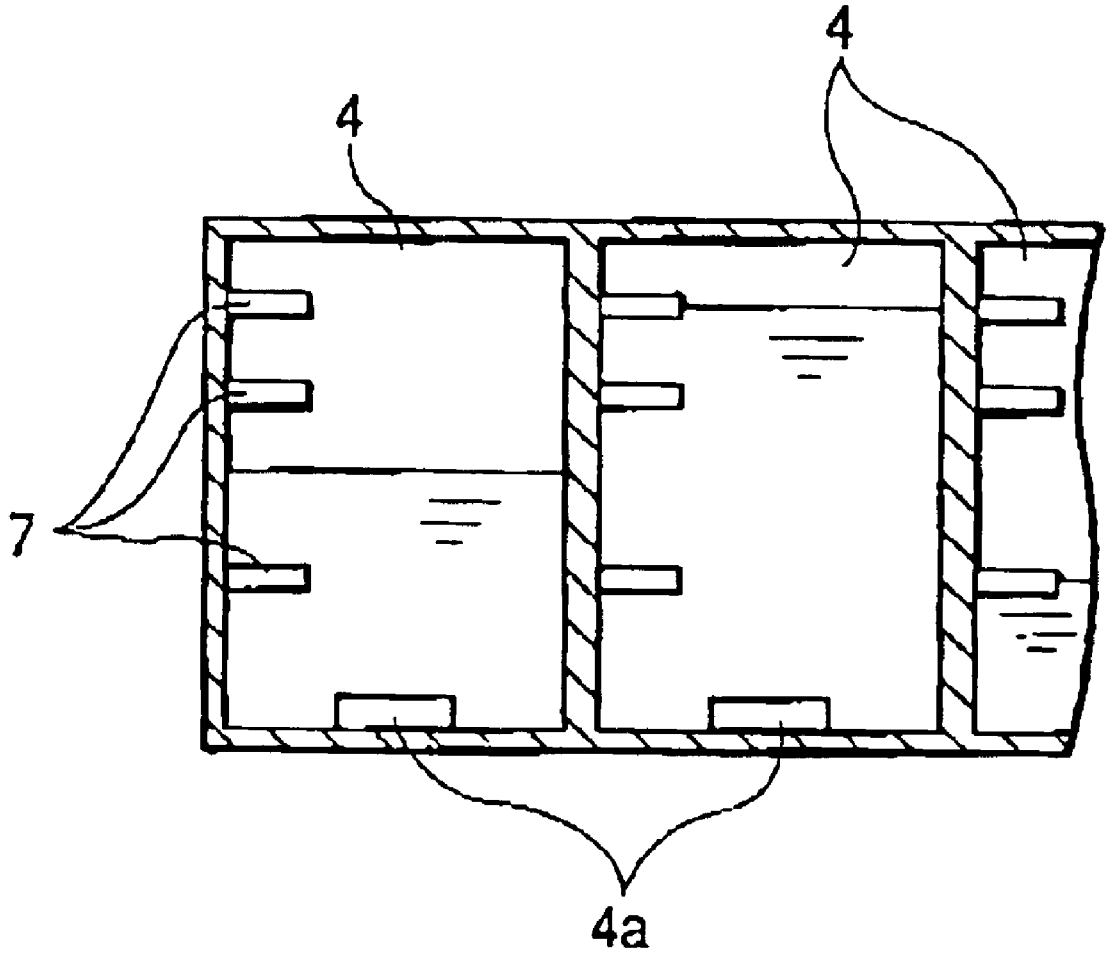
FIG. 3 is a typical sectional diagram showing the structure of a remaining amount sensor of the on-carriage ink tank of the recording apparatus shown in FIG. 1.

The supply tubes 6 are ordinarily held at the pull-off position, whereby the carriage 8 can be scanned to perform the record operation in this state. The supply tubes 6 are moved to the ink supply position only when the ink supply operation is performed. In this state, the main ink tank 19 is connected to the on-carriage ink tanks 4 through the respective supply tubes 6, whereby the inks are supplied from the main ink tank 19 to the on-carriage ink tanks 4 by driving a not-shown pump or the like, As shown in FIG. 3, electrodes 7 are provided at predetermined height positions in the on-carriage ink tank 4, and these electrodes 7 constitute a level sensor to detect whether or not the ink is filled up to each electrode 7. The ink supply operation to the on-carriage ink tank 4 ends when it is detected by the level sensor that the ink of a predetermined amount is filled in the on-carriage ink tank 4. That is, the pump is stopped, and the supply tubes 6 are moved to the pull-off position.

Since the recording apparatus 1 of the present embodiment uses the intermittent supply system as described above, the ink supply path is away from the carriage 8 during the recording operation. Thus, a space where the tube is disposed need not be provided, whereby the entire structure of the apparatus can be made compact. Moreover, the capacity of the on-carriage ink tank 4 can be small, and the movement load of the carriage due to the tube does not increase, whereby the driving force to drive the carriage 8 can be small. Therefore, a motor and its peripheral circuits used as the driving mechanism of the carriage 8 can be minimized.

Figure 4:
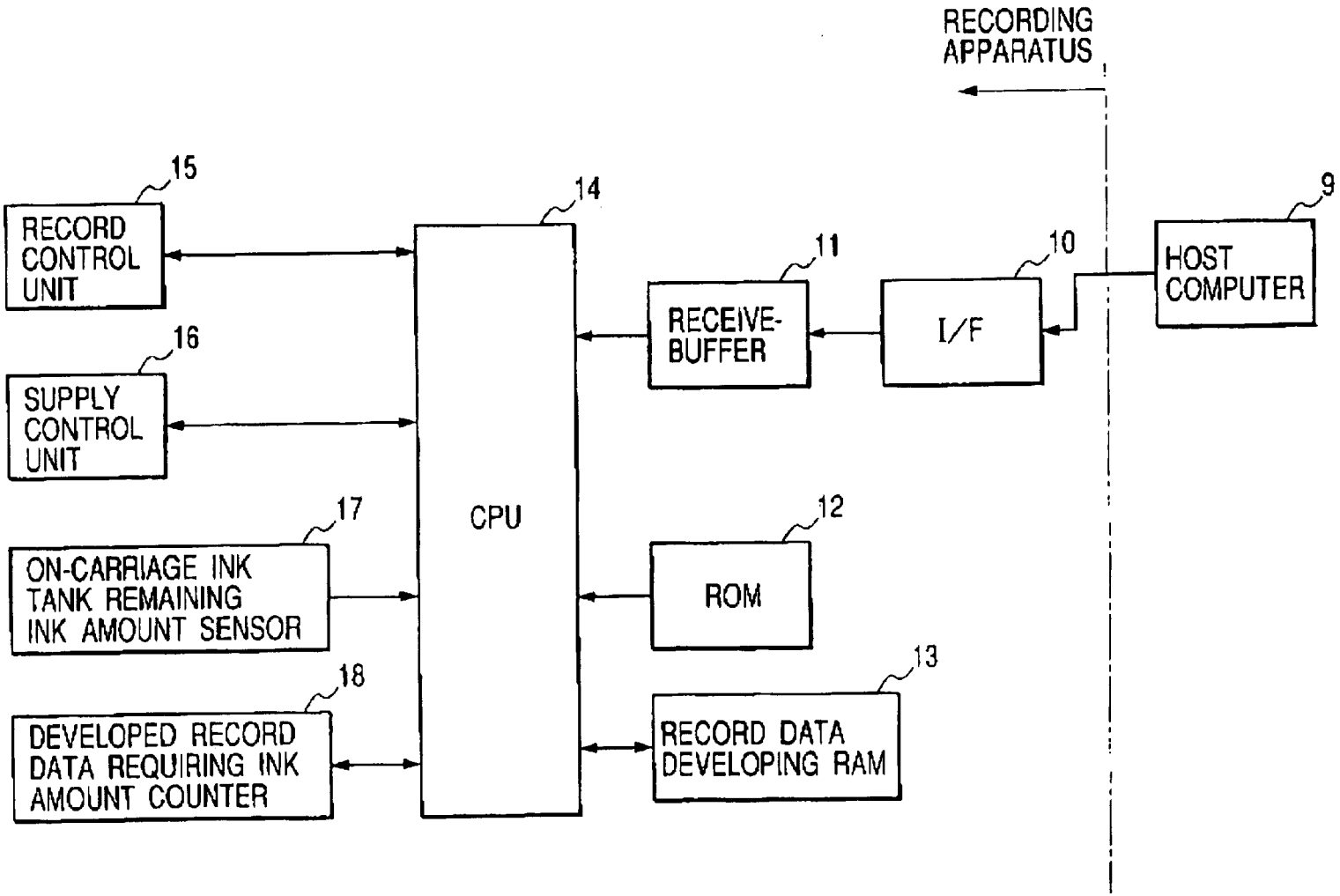
FIG. 4 is a block diagram showing the structure of a control unit of the recording apparatus shown in FIG. 1.

Next, a sequence to give ink supply timing to the on-carriage ink tank 4 in the recording apparatus 1 of the present embodiment will be explained. FIG. 4 is a block diagram showing the structure of a control unit of the recording apparatus 1 which executes this sequence, particularly, as paying attention to-the portion used to giving the ink supply timing.

A CPU 14 which operates according to programs stored in a ROM 12 and composed of various operation commands is used to perform the record operation in addition to the ink supply operation. Therefore, a supply control unit 16 causing a liquid supply mechanism such as the movement means of the supply tubes 6, the pump and the like to operate, and a record control unit 15 causing the driving mechanisms such as the record head 5, the carriage 8, the conveyance roller 3 and the like are connected to the CPU 14. Also, an on-carriage ink tank remaining ink amount sensor 17 which includes the above electrodes 7 is connected to the CPU 14.

The recording apparatus 1 of the present embodiment is the apparatus which operates in response to a record instruction supplied from an external host computer 9, and a signal sent from the host computer 9 is input into the recording apparatus 1 through an interface (I/F) 10. The signal received through the interface 10 is temporarily stored in a receiver-buffer 11, and the CPU 14 appropriately captures the stored signal from the receiver-buffer 11 and performs an operation based on the captured signal.

The CPU 14 converts image data included in the signals stored in the receiver-buffer 11 into record data suitable for actually recording the image based on the image data, in accordance with the resolution and the number of dots of the record head 5. The obtained record data is then stored in a record data developing RAM 13. In this case, in the recording apparatus 1 of the present embodiment, an ink amount required to perform the record operation according to the developed record data is appropriately calculated and accumulated in a counter 18 for accumulating an ink amount required by a developed record data.

The record operation is appropriately performed according to the record data stored in the record data developing RAM 13 if a record instruction signal is output from the CPU 14 to the record control unit 15. It should be noted that the record operation can be performed in parallel with the signal reception from the host computer 9.

Next, an operation according to the sequence to give the ink supply timing will be explained with reference to the flow chart shown in FIG. 5. Here, it should be noted that this sequence is appropriately executed after the record instruction signal is input from the host computer 9.

First, in a step S1, the CPU 14 obtains the ink amount of the on-carriage ink tank 4 in response to the signal sent from the on-carriage ink tank remaining ink amount sensor 17, and then substitutes the obtained ink amount for an ink amount Iy.

Next, in a step S2, as described above, the CPU 14 performs a record data development process to convert the image data of a certain amount stored in the receiver-buffer 11 into the record data. Then, in a step S3, the CPU 14 calculates the ink amount required by the developed record data and stores the calculated data in the developed record data requiring ink amount counter 18. Therefore, the used ink amount according to the record data to which the development process has ended is successively counted by the developed record data requiring ink amount counter 18. In FIG. 5, it should be noted that the counted value is represented as an ink amount IS required by the developed record data.

Next, in a step S4, if the record data obtained by developing the image data corresponding to the portion not yet developed represents a so-called solid image, the ink amount required to perform the recording according to this record data is calculated and substituted for an ink amount IM as a maximum ink amount required by undeveloped record data.

In the present embodiment, the ink amount IM is calculated on the basis of (1) the maximum required ink amount in case of recording the solid image on the maximum-sized paper capable of being managed by the recording apparatus 1, and (2) a ratio of the developed image data in the entire image data when it is assumed that the image data sent from the host computer 9 is the record image data to be recorded to the maximum-sized paper. For example, it is assumed that the ink of 1 cc is required if the recording apparatus 1 manages the paper up to A4 size and records the solid image of "intense black" to the A4 paper, and that the development of the record data has ended by 30%. In such a case, the portion not yet expanded is 70%, whereby 1 cc×70%=0.7 cc is substituted for the ink amount IM.

Next, in a step S5, an estimation value (IS+IM) of the ink amount required to perform the recording on the next paper is compared with the ink amount Iy in the on-carriage ink tank 4. Then, if the ink amount Iy is larger than the estimation value (IS+IM), this comparison result represents that the ink of the amount sufficient to perform the recording on the next paper remains in the on-carriage ink tank 4, whereby the flow advances to a step S8 to start the recording. Here, the record operation is successively performed in parallel with the record data development process.

On the other hand, if the ink amount Iy is smaller than the estimation value (IS+IM), this comparison result represents that there is a possibility that the ink in the on-carriage ink tank 4 runs down while the recording is being performed on the next paper. However, since the maximum ink amount IM of the undeveloped portion is used as the above judgment, there is a possibility that the ink is sufficient according to the actual image data.

Figure 5:
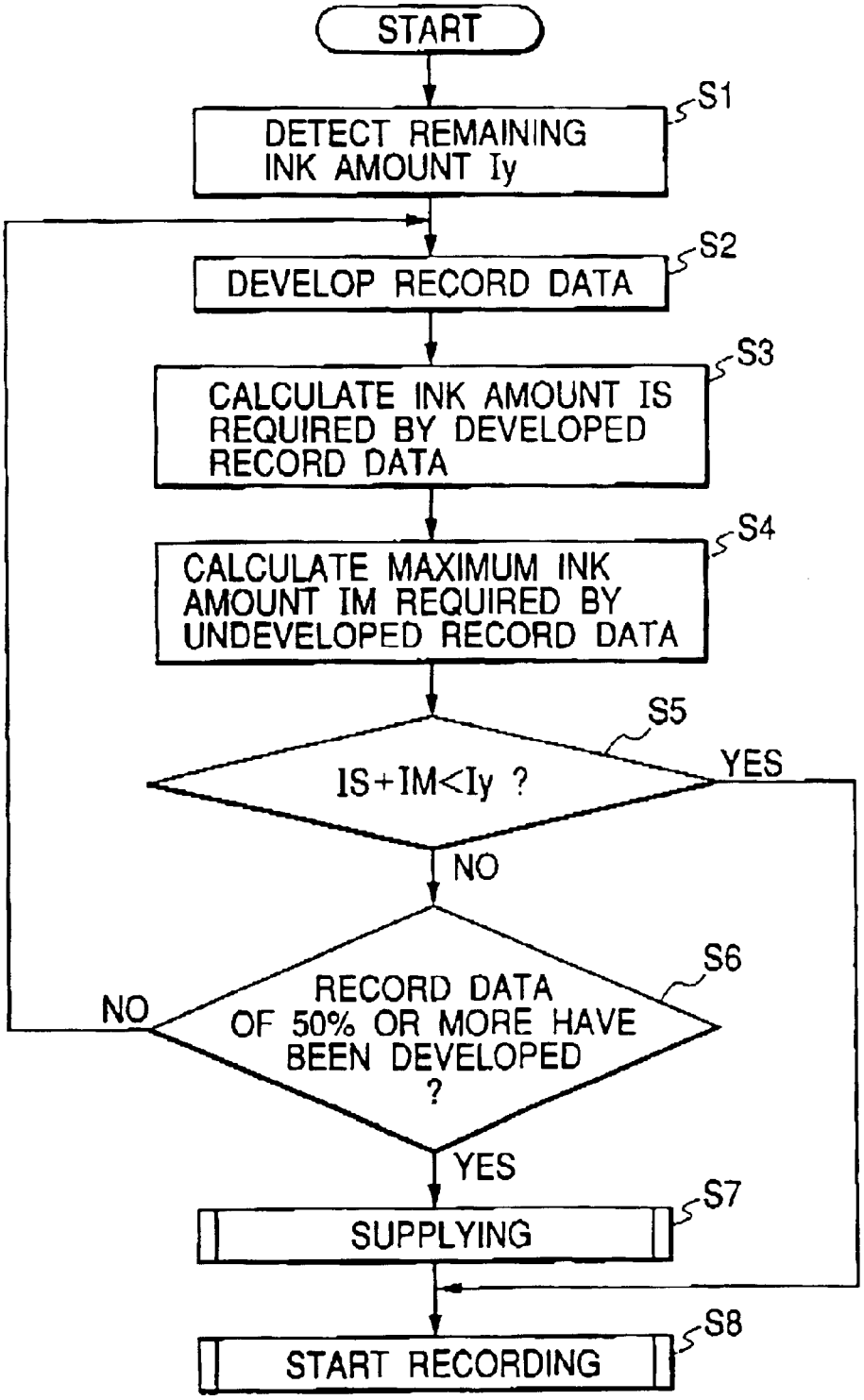
FIG. 5 is a flow chart showing an operation based on a sequence of giving ink supply timing to the on-carriage ink tank, in the recording apparatus shown in FIG. 1.

Thus, it is further judged in a step S6 whether or not the record data have been developed by a certain amount, i.e., 50% or more in the example of FIG. 5. If the record data is not yet developed by the certain amount, the flow returns to the step S2 to further perform the record data development process and again perform the judgment in the step S5. Thus, the development process is sequentially performed, and the recording starts at the time when it is judged in the step S5 that the recording to the next paper can be performed by the ink in the on-carriage ink tank 4.

On the other hand, if the record data have been developed by 50% or more, when it is judged that there is a possibility that the ink amount in the on-carriage ink tank 4 is insufficient to the amount required to perform the recording on the next paper, the flow advances to a step S7 to perform the ink supply operation and then further advances to the step S8 to start the recording.

In the time expended to perform the supply operation, a ratio of the time expended for the operation to move the carriage 8 to the supply position and the operation to move the supply tube 6 to the supply position is large, while a ratio of the time expended to flow the ink after the main ink tank 19 is connected to the on-carriage ink tank 4 is not so large. Therefore, the time expended for the supply operation does not so change according to whether the ink should be supplied to the on-carriage ink tank 4 up to which extent, whereby it is desirable that the supply operation is performed until the on-carriage ink tank 4 becomes full.

As explained above, according to the present embodiment, the ink amount required for the recording is estimated before the recording to the one paper starts. Then, if it is estimated that the ink amount in the on-carriage ink tank 4 is insufficient to the required amount, the recording operation is performed after the ink is supplied to the on-carriage ink tank 4. Thus, according to the present embodiment, the recording can be performed without inviting the situation that the ink supply operation is required while the recording to the one paper is being performed.

In this case, since the required ink amount is estimated according to the actual record data, frequency of the ink supply operation can be reduced as compared with the conventional method that the ink is supplied if the amount of the ink held in the on-carriage ink tank is less than the ink amount required to record the solid image on the one paper. Therefore, it is possible to reduce that waste of time increases in the record operation. Moreover, since frequency of the connection operation for connecting the supply tube 6 to the valve 4*a* can be reduced, a lifetime of the valve can be prolonged.

Moreover, the process to gradually bring the required ink amount close to the accurate amount according to the record data as performing the record data development process is performed, and it is successively judged whether or not the ink is sufficient. Then, the record operation starts at the time when it is judged that the ink is sufficient, waste of time until the record operation starts can be minimized.

Then, if recorded contents are checked in a case where general documents and web pages on the Internet are recorded, it is understood that about 10% of the end portion of the paper is often a blank portion. That is, even if only 10% of the end of the image is developed and the remaining 90% portion of the image is the solid image, it is possible to judge that the ink amount required for the recording is 90% of the ink amount required in the case where the entire image is the solid image. For this reason, according to the present embodiment, even if the ink amount in the on-carriage ink tank 4 has decreased, it is possible to judge, at the time when the headmost data is received only a little and subjected to the development process, that the ink is sufficient, whereby a useless supply operation can be often refrained.

Moreover, the image data of the blank portion is generally transmitted as a skip instruction from the host computer 9 or transmitted as end blank portion amount data in the form of a command of which the data amount is extremely small. Therefore, it is often possible to judge that the supply operation is not required in a short time from the beginning of the signal reception from the host computer 9.

In the present embodiment, the judgment as to whether or not the supply operation should be performed ends at the time when the image data is developed by a certain amount, and thereafter the development process and the record operation are performed in parallel. Therefore, the memory capacity of the record data developing RAM 13 can be smaller than the memory amount by which the record data of the entire one page can be developed. That is, even if the judgment is discontinued, the first blank portion in the record image is evaluated as above, it is possible to effectively prevent that the useless supply operation is performed.

In the present embodiment, the estimation of the required ink amount is discontinued at the time when the record data is developed by 50%. However, it is possible to appropriately set whether the estimation should be discontinued at the time when the record data is developed to which extent, in accordance with the securable memory amount of the record data developing RAM 13 and the like.

Moreover, the present embodiment is preferably applicable particularly to the ink-jet recording apparatus which performs the recording by emitting the ink. In this case, the record head includes nozzles to emit the inks, and the ink supplied to the record head is held within the nozzle in the state that a meniscus is strained. In order to hold the ink without leaking it from the nozzle of the record head even in such a state, the on-carriage ink tank 4 is structured to slightly generate negative pressure. As a method of generating the negative pressure, for example, there is generally the method of generating the negative pressure by using capillary attraction of a sponge, but the negative pressure may be generated by another method.

(Second Embodiment)

In the first embodiment, the ink amount in the on-carriage ink tank 4 is detected by the on-carriage ink tank remaining ink amount sensor 17 (see FIG. 4) structured by the electrodes 7 (see FIG. 3). On the other hand, the ink amount in the on-carriage ink tank 4 may be calculated by a software process without using such a sensor. In the present embodiment, a method of calculating the ink amount in the on-carriage ink tank 4 by the software process will be described.

That is, in the present embodiment, a remaining ink amount counter is used instead of the on-carriage ink tank remaining ink amount sensor 17. The remaining ink amount counter is reset when the on-carriage ink tank 4 is full. Then, in accordance with the driving instruction sent to the record head, the ink amount consumed in the operation of the recording head responsive to the driving instruction is counted by the remaining ink amount counter. Moreover, an amount of evaporation of the ink due to elapse of time is counted by the remaining ink amount counter.

Moreover, particularly in the ink-jet recording apparatus, ordinarily, a recovery operation to eliminate the viscous ink and the like within the nozzles by forcibly sucking the ink from the nozzles of the record head 5 is performed at predetermined timing. Thus, the ink amount consumed in such a recovery operation is also counted by the remaining ink amount counter.

In this way, the ink amount in the on-carriage ink tank 4 can be grasped by referring to the remaining ink amount counter, and the obtained amount can be used to judge whether or not the supply operation should be performed.

(Third Embodiments)

In the first embodiment, there is described the method of estimating the required ink amount IM of the undeveloped portion (see FIG. 5) on the basis of the ink amount required when the solid image is recorded to the maximum-sized paper capable of being managed by the recording apparatus 1. However, if the size of the paper to which the recording is performed is grasped beforehand and then the required ink amount is calculated based on the grasped paper size, the required ink amount can be calculated more accurately. In the present embodiment, such a method will be described.

In recent years, a printer driver is installed in the host computer 9 such as a personal computer or the like and thus used. For example, the printer driver is supplied together with the recording apparatus 1. Thus, various information other than the image data can be added to the data to be sent from the host computer 9 to the recording apparatus 1 by the printer driver.

The added information includes "paper size" information, and this information is added as the header to the beginning of the data sent from the host computer 9. Thus, on the basis of the "paper size" information included in the header of the data, the ink amount required when the solid image is recorded to the paper of this size can be obtained, and the obtained ink amount can be used to calculate the required ink amount IM of the undeveloped portion.

According to the present embodiment, the ink amount required to perform the recording to the next paper can be calculated more accurately, whereby frequency of the supply operation can be further reduced. The method of the present embodiment is effective particularly to the recording apparatus which can perform the recording to the different-sized sheets of paper of which the areas are remarkably different from others. For example, the area of A3 paper is eight times or more as much as the area of a postcard, and also the maximum required ink amount for the A3 paper is eight times or more as much as that for the postcard. Therefore, in the recording apparatus which can perform the recording to both the A3 paper and the postcard, the required ink amount is calculated according to each size, whereby it is possible to effectively prevent that a useless supply operation is performed.

Moreover, there is a case where also information such as "record quality mode" information, "paper kind" information or the like is included in the head of the signal to be sent from the host computer 9 to the recording apparatus 1. Here, the "record quality mode" information is the information representing, e.g., in which of an "HQ record mode" to record a high-quality image and an "HS record mode" to perform high-speed recording as somewhat degrading the image quality the recording should be performed.

In the "HS record mode", the recording is ordinarily performed with 50% duty as compared with the "HQ record mode" whereby the maximum-required ink amount in the "HQ record mode" is twice as much as the maximum-required ink amount in the "HS record mode". Therefore, the maximum-required ink amount is obtained on the basis of the "record quality mode" information, and the obtained amount is used to calculate the required ink amount IM of the undeveloped portion, whereby the ink amount IM can be calculated more accurately, and thus the timing of the supply operation can be more appropriately determined.

Moreover, with respect to the "paper kind" information, particularly in the ink-jet recording apparatus, there is a case where an ink-jet dedicated paper to which the recording can be performed at density of 200% as compared with a plain paper is used. In this case, the maximum-required ink amount in case of performing the recording to the plain paper is remarkably different from that in case of performing the recording to the ink-jet dedicated paper. Therefore, the maximum-required ink amount is obtained on the basis of the "paper kind" information, and the obtained amount is used to calculate the required ink amount IM of the undeveloped portion, whereby the ink amount IM can be calculated more accurately, and thus the timing of the supply operation can be more appropriately determined.

Besides, if there are plural record modes to perform record operations of which the maximum-required ink amounts are different from others, it is preferable to pick up the information as to these modes from the header of the signal sent from the host computer 9 and reflect the picked-up information on the calculation of the ink amount IM.

(Fourth Embodiment)

In the third embodiment, the method of obtaining the record mode information such as the "paper size" information, the "record quality mode" information, the "paper kind" information and the like from the information attached to the signal sent from the host computer 9 is described. On the other hand, in the present embodiment, a method of obtaining the record mode information in another way will be described.

That is, the "paper size" information and the "paper kind" information may be detected respectively by a paper width detection mechanism (record medium detection means) and a paper kind detection mechanism (record medium kind detection means) which are provided in the recording apparatus. Moreover, there is a case where the record mode information, particularly the "record quality mode" information or the like, is set on an operation panel (input means) provided on the recording apparatus 1. In this case, the maximum-required ink amount may be obtained on the basis of the record mode set on the operation panel.

(Fifth Embodiment)

In the first embodiment, the structure that the ink is supplied from the main ink tank 19 to the on-carriage ink tank 4 by inserting the supply tube 6 into the valve 4*a* provided in the on-carriage ink tank 4 is described. In this structure, as described above, the load to the carriage due to the movement of the tube during the record operation can be decreased as compared with the on-carriage ink tank system in which the ink is supplied in the state that the tube is connected to the on-carriage ink tank all the time, and, moreover, the space where the tube is disposed is not required.

However, if there is room in the size of the apparatus and the driving power of the carriage 8, the present invention may be applied to the recording apparatus in which a flexible tube connecting the on-carriage ink tank 4 and the main ink tank 19 with each other all the time is provided, and a valve is provided in the ink path constituted by this tube. In this case, the valve is closed usually, and then opened at the timing determined as above when it is required to supply the ink to the on-carriage ink tank 4, whereby the ink supply is performed.

In this case, since the valve is opened only when the ink is supplied, an effect that a fluctuation of ink supply pressure, due to inertia of ink, which might be generated in the on-carriage ink tank system can be prevented is achieved. The fluctuation of ink supply pressure becomes the factor to cause a pressure fluctuation within the on-carriage ink tank. Here, particularly in the ink-jet printing apparatus, the pressure fluctuation within the on-carriage ink tank prevents the ink meniscus from being satisfactorily strained and thus becomes the factor to degrade the record quality. Thus, by preventing such pressure fluctuation, it is possible to improve the record quality particularly in the ink-jet printing apparatus.

As explained above, according to the above embodiments, in the recording apparatus which adopts the intermittent supply system, the ink amount required to perform the recording on the next record medium is calculated based on the image data sent from the host computer, and the ink supply operation is performed to the on-carriage ink tank before the record operation is performed if the ink amount of the on-carriage ink tank is insufficient, whereby the recording can be performed without inviting the situation that the ink supply operation is required while the recording to the one paper is being performed.

Moreover, in this case, since the required ink amount is estimated according to the actual record data, the frequency of the ink supply operation can be minimized, whereby waste of time due to the ink supply operation can be minimized. Moreover, the process to gradually bring the required ink amount close to the accurate amount according to the record data is performed while the image data is being received, it is successively judged whether or not the ink is sufficient, and then the record operation starts at the time when it is judged that the ink is sufficient, whereby waste of time until the record operation starts can be minimized.

Moreover, the judgment as to whether or not the supply operation should be performed is discontinued at the time when the image data is developed by the certain amount, whereby the memory which stores the record data need not be provided for the entire record data of one page, and thus the required memory amount can be reduced.

What is claimed is:

1. An ink-jet recording apparatus which performs recording by emitting ink from a record head to a record medium in accordance with record data, comprising:

a carriage, equipped with the record head, for performing reciprocation;

a first ink tank mounted on said carriage;

a second ink tank disposed at a position distant from said carriage;

ink supply means for supplying the ink from said second ink tank to said first ink tank;

remaining ink amount detection means for detecting a remaining ink amount in said first ink tank;

first calculation storage means for calculating a first ink amount required to record a part of the image data which has already been subjected to a development process, and for storing the calculated first ink amount;

second calculation storage means for calculating a maximum ink amount required to record image data which has not already been subjected to the development process, and for storing the calculated maximum ink amount; and control means for starting the record operation at a time when a sum total value of the first ink amount stored in said first calculation storage means and the maximum ink amount stored in said second calculation storage means becomes lower than the ink amount detected by said remaining ink amount detection means.

2. An ink-jet recording apparatus according to claim 1, wherein, even if said first calculation storage means calculates the image data of a predetermined amount or more, said control means starts the record operation after the ink is supplied from said second ink tank to said first ink tank by said ink supply means, in a case where the sum total value of the ink amount stored in said first calculation storage means and the maximum ink amount stored in said second calculation storage means is larger than the ink amount detected by said remaining ink amount detection means.

3. An ink-jet recording apparatus according to claim 1, wherein said remaining ink amount detection means includes electrodes disposed in said first ink tank.

4. An ink-jet recording apparatus according to claim 1, wherein said remaining ink amount detection means detects the remaining ink amount in said first ink tank by counting a consumption amount of the ink from a time when said first ink tank is filled with the ink.

5. An ink-jet recording apparatus according to claim 1, wherein said second calculation storage means calculates the maximum required ink amount on the basis of record mode information.

6. An ink-jet recording apparatus according to claim 5, wherein the record mode information includes information representing a size of the record medium.

7. An ink-jet recording apparatus according to claim 6, further comprising record medium size detection means for detecting the size of the record medium, wherein said second calculation storage means obtains the information of the size of the record medium from said record medium size detection means.

8. An ink-jet recording apparatus according to claim 5, wherein the record mode information includes record quality mode information representing which of plural record modes, each having different pixel density, the recording should be performed in.

9. An ink-jet recording apparatus according to claim 5, wherein the record mode information includes information representing a kind of record medium.

10. An ink-jet recording apparatus according to claim 9, further comprising record medium kind detection means for detecting the kind of record medium, wherein said second calculation storage means obtains the information of the kind of record medium from said record medium kind detection means.

11. An ink-jet recording apparatus according to claim 5, wherein said second calculation storage means obtains the record mode information from the image data to be sent to said recording apparatus.

12. An ink-jet recording apparatus according to claim 5, further comprising input means used for input by a user, wherein said second calculation storage means obtains the record mode information from information input from said input means.

13. An ink-jet recording apparatus according to claim 1, wherein said ink supply means includes an ink inlet provided through said first ink tank, a valve composed of an elastic body disposed in said ink inlet, a supply tube connected to said second ink tank, and movement means for moving said supply tube to a position distant from said first ink tank and a position where said supply tube is inserted into said first ink tank through said valve, in a state that said carriage has been moved to a predetermined position.

14. An ink-jet recording apparatus according to claim 1, wherein said ink supply means includes a flexible tube connecting said second ink tank and said first ink tank to each other, and an openable valve disposed in an ink path constituted by said tube.

15. A recording method for an ink-jet recording apparatus which comprises a carriage, equipped with a record head, for performing reciprocation, a first ink tank mounted on the carriage, a second ink tank disposed at a position distant from the carriage, an ink supply means for supplying ink from the second ink tank to the first ink tank, and which performs recording by emitting the ink from the record head to a record medium in accordance with record data, said method comprising:

a step of detecting a remaining ink amount in the first ink tank;

a first calculation storage step of calculating a first ink amount required to record a part of the image data which has already been subjected to a development process, and of storing the calculated first ink amount;

a second calculation storage step of calculating a maximum ink amount required to record image data which has not already been subjected to the development process, and of storing the calculated maximum ink amount;

a step of comparing a sum total value of the first ink amount stored in said first calculation storage step and the maximum ink amount stored in said second calculation storage step with the remaining ink amount in the first ink tank; and a step of starting the record operation at a time when the sum total value becomes lower than the remaining ink amount in the first ink tank.

16. A recording method according to claim 15, further comprising a step, even if said first calculation storage step calculates the image data of the predetermined amount or more, of starting the record operation after the ink is supplied from the second ink tank to the first ink tank by the ink supply means, in a case where said sum total value is larger than the remaining ink amount in the first ink tank.

* * * * *

UNITED STATES PATENT AND TRADEMARK OFFICE

CERTIFICATE OF CORRECTION

PATENT NO. : 6,776,471 B2
DATED : August 17, 2004
INVENTOR(S) : Takashi Nojima

It is certified that error appears in the above-identified patent and that said Letters Patent is hereby corrected as shown below:

Column 2,
Line 2, “enlarged,” should read -- enlarged. --.

Column 4,
Line 64, “like,” should read -- like. --.

Column 5,
Line 21, “to-the” should read -- to the --.

Signed and Sealed this

First Day of March, 2005

JON W. DUDAS
*Director of the United States Patent and Trademark Office*